United States Patent [19]
Dichter et al.
[11] 4,141,165
[45] Feb. 27, 1979

[54] DOUBLE ACTION REVOLVER APPARATUS AND METHOD

[75] Inventors: Wilhelm Dichter, Vernon, Conn.; Henry J. Tatro, Westfield, Mass.; C. Edward Warner, West Simsbury, Conn.

[73] Assignee: Colt Industries Operating Corp., Hartford, Conn.

[21] Appl. No.: 819,127

[22] Filed: Jul. 26, 1977

[51] Int. Cl.[2] ..... F41C 1/00; F41C 19/00
[52] U.S. Cl. ..... 42/65; 42/59; 42/67
[58] Field of Search ..... 42/65, 66, 67, 59, 5, 42/69 R, 69 B, 39.5

[56] References Cited

U.S. PATENT DOCUMENTS

| | | | |
|---|---|---|---|
| 12,470 | 2/1855 | Hollingsworth et al. | 42/65 |
| 12,471 | 2/1855 | Hollingsworth et al. | 42/65 |
| 432,368 | 7/1890 | Carter et al. | 42/65 |
| 432,369 | 7/1890 | Carter et al. | 42/65 |
| 457,278 | 8/1891 | Houston | 42/65 |
| 465,179 | 12/1891 | Johnson et al. | 42/65 |
| 1,487,722 | 3/1924 | Coenders | 42/59 |
| 1,608,359 | 11/1926 | Biason | 42/69 R |
| 1,752,324 | 4/1930 | Bochnak | 42/59 |
| 2,853,823 | 9/1958 | Kirkland | 42/67 |
| 3,050,892 | 8/1962 | Vogler et al. | 42/5 |
| 3,145,495 | 8/1964 | Katz et al. | 42/59 |
| 3,369,314 | 2/1968 | Ramsay | 42/39.5 |
| 3,729,853 | 5/1973 | Critcher | 42/65 |
| 3,765,116 | 10/1973 | Zaid | 42/59 |
| 3,810,326 | 5/1974 | Hillberg | 42/65 |
| 3,903,630 | 9/1975 | Dirstine | 42/65 |
| 4,067,131 | 1/1978 | Ruger et al. | 42/65 |

FOREIGN PATENT DOCUMENTS

| | | | |
|---|---|---|---|
| 186131 | 9/1922 | United Kingdom | 42/67 |

*Primary Examiner*—Charles T. Jordan
*Attorney, Agent, or Firm*—Radford W. Luther; Richard A. Dornon

[57] ABSTRACT

A double action revolver has a frame on which is mounted a cylinder, a trigger and a hammer. A hammer or main spring is interposed between the trigger and hammer such that pulling the trigger causes the spring to compress and bias the hammer toward its fired position. The position of the hammer remains essentially unchanged during initial trigger pull by virtue of a toggle spring device interposed between the frame and the hammer. When the hammer spring is sufficiently compressed, a surface on the trigger contacts and engenders a deflection or buckling of the toggle spring device. Buckling of the toggle spring device permits the hammer spring to drive the hammer to the fired position in which a cartridge is fired.

A spring loaded cylinder stop, having a projection adapted to be received in a locking recess on the cylinder, is adapted to be displaced forwardly, against the bias of its spring load during initial trigger return from the pulled position to its normal or released position. Each locking recess is constituted by a primary locking notch and secondary locking notch. The primary and secondary notches are so arranged that forward movement of the cylinder stop causes it to leave the primary notch and enter the secondary notch. This permits the cylinder to be rotated a few degrees under the impetus of a cylinder spring. Further trigger return permits the cylinder stop to move rearwardly out of the secondary notch and over the surface of the cylinder. When the cylinder stop clears the secondary notch, the cylinder automatically rotates to the next index position where the cylinder stop enters the succeeding primary locking notch and terminates cylinder rotation.

16 Claims, 54 Drawing Figures

Fig. 18
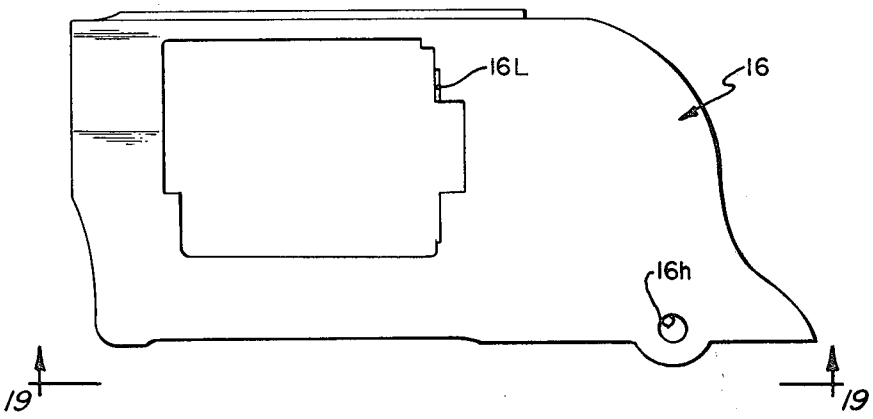
Fig. 19
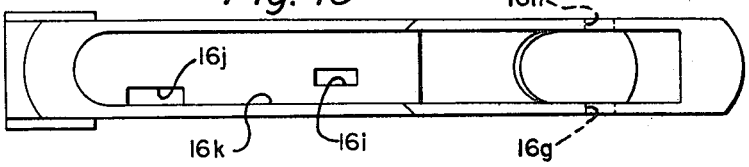
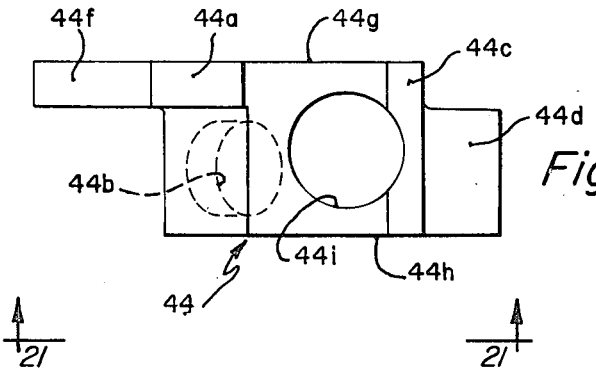
Fig. 20
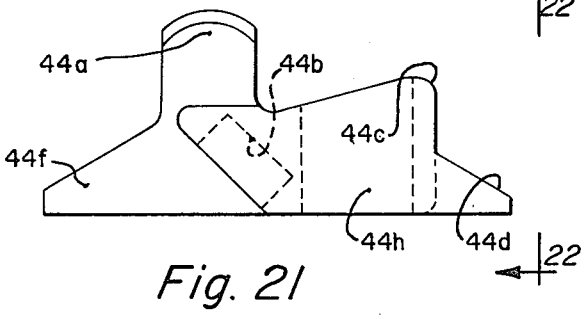
Fig. 21
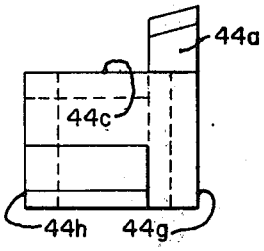
Fig. 22

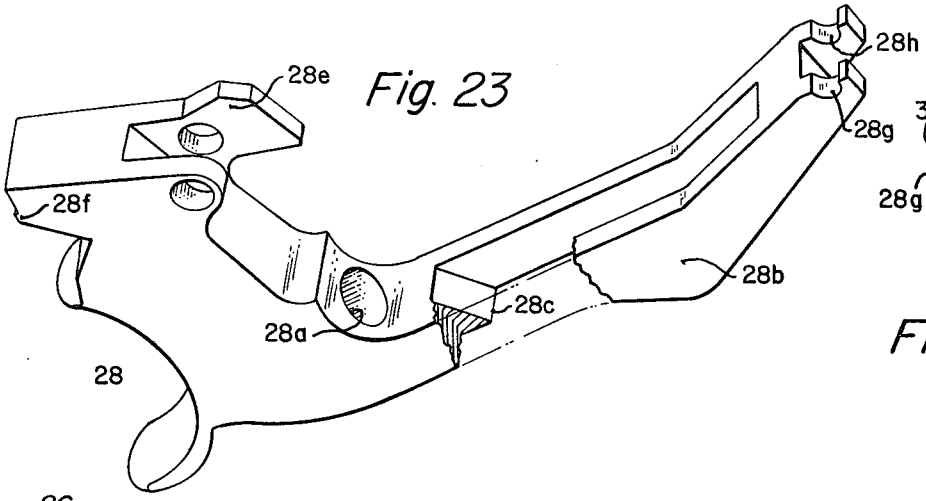
Fig. 23
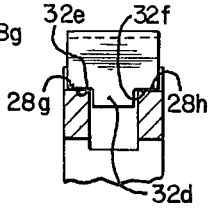
Fig. 24
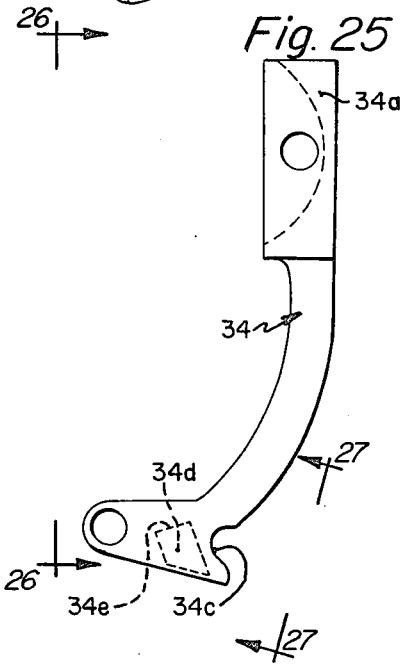
Fig. 25
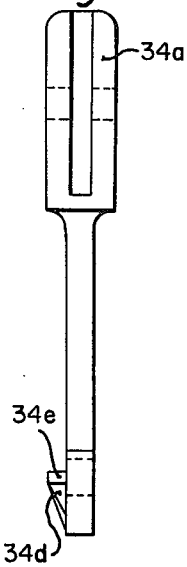
Fig. 26
Fig. 27
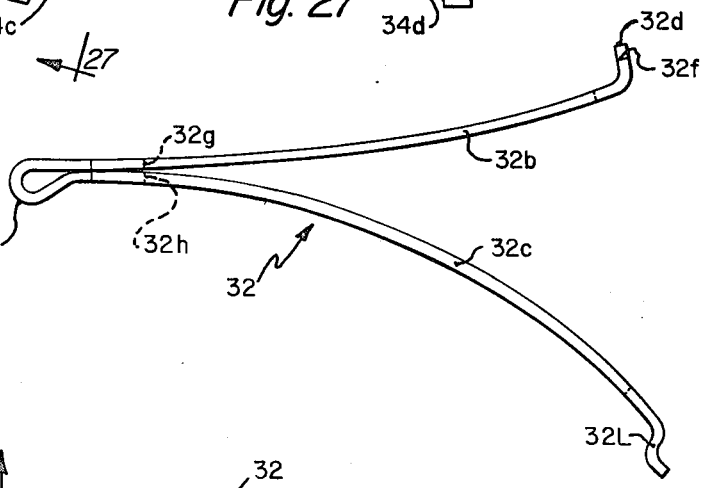
Fig. 28
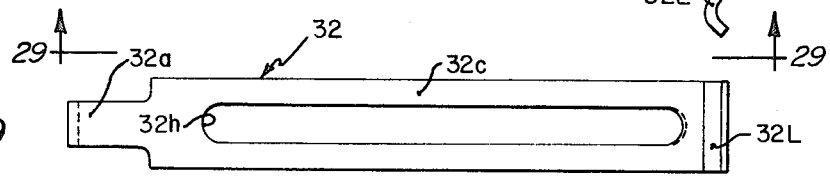
Fig. 29

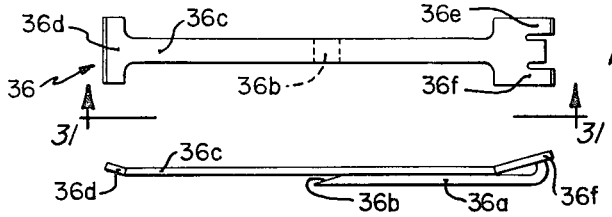
Fig. 30
Fig. 31
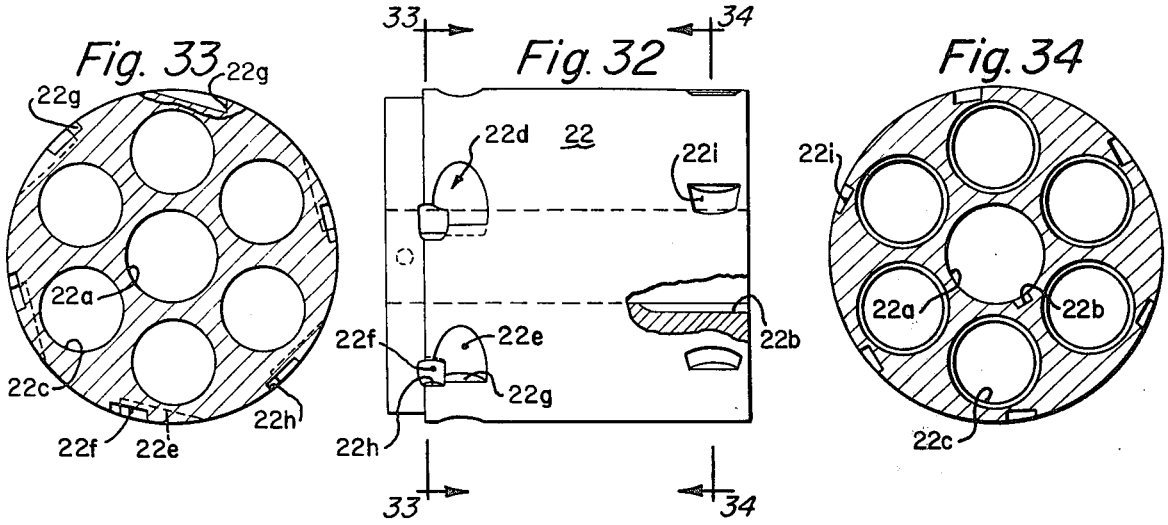
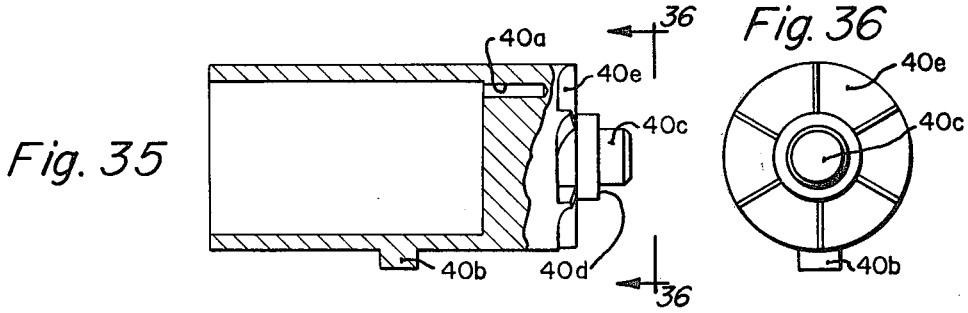
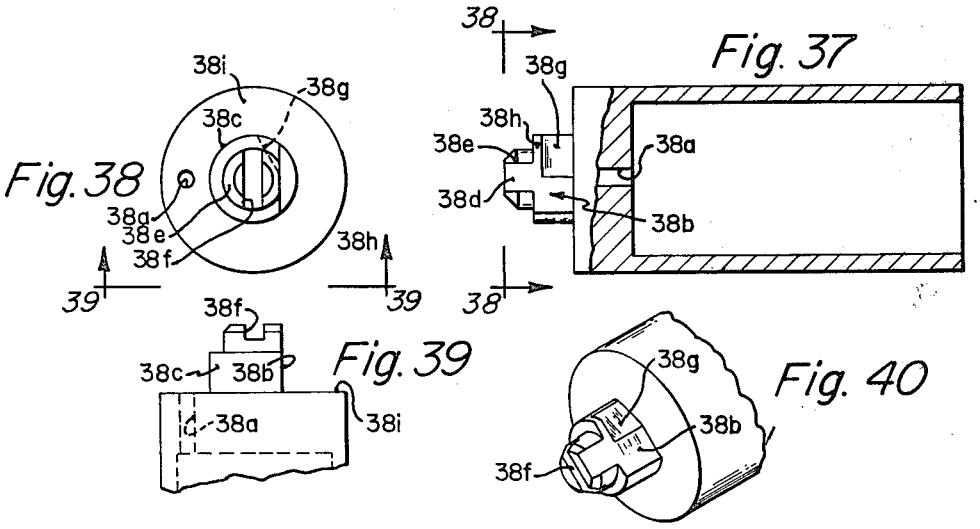

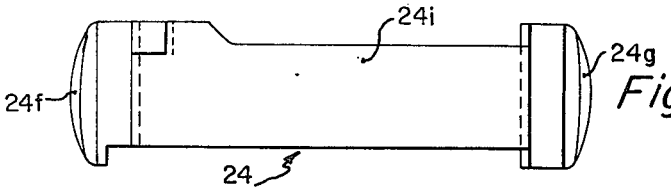
Fig. 41
Fig. 44
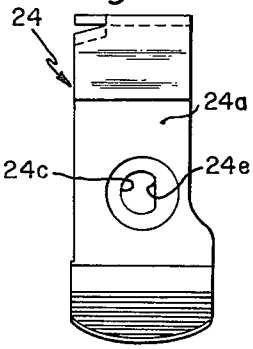
Fig. 42
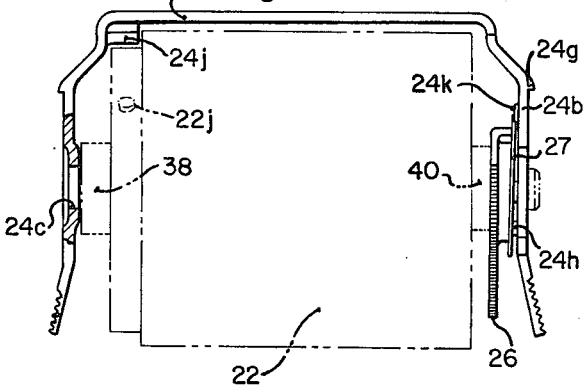
Fig. 43
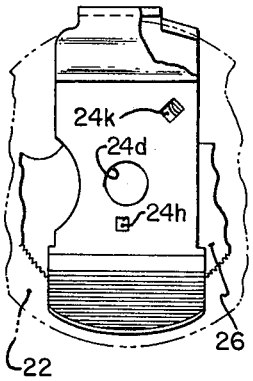
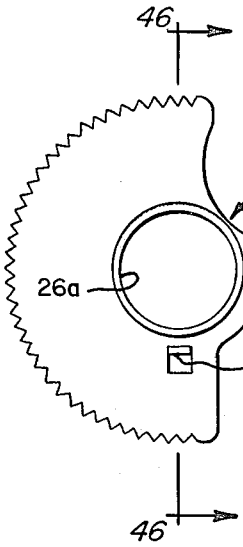
Fig. 45
Fig. 46
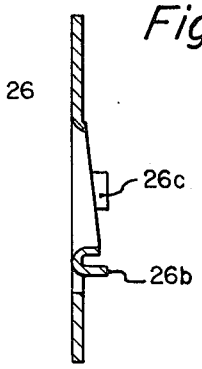
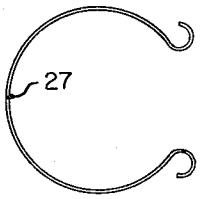
Fig. 47

DOUBLE ACTION REVOLVER APPARATUS AND METHOD

BACKGROUND OF THE INVENTION

This invention relates to double action revolvers.

Present day revolvers are relatively expensive to manufacture. This is due in large part to the great amount of hand fitting which is required. Typically, the searing surfaces of the hammer and trigger must be hand filed in addition to the pawl and cylinder ratchet.

Also, present double action revolvers require a large force to pull the trigger. Such a large force militates against accuracy and ease of operation.

SUMMARY OF THE INVENTION

The invention provides a double action revolver which has a construction that readily lends itself to low-cost manufacture. The hammer and trigger are devoid of searing surfaces which normally require hand fitting. Also, provision is made for the automatic indexing of the cylinder during trigger return, thereby obviating the usual pawl and ratchet arrangement for turning the cylinder between discrete index positions. Because the trigger is relieved of supplying the energy to turn the cylinder and the unique means to bias the hammer toward the fired position during trigger pull, a revolver of the invention can exhibit a significantly reduced and smoother trigger pull.

In an embodiment of the invention, a hammer or main spring, interposed between the hammer and the trigger, is compressed during trigger pull to bias the hammer toward the fired position. A toggle spring device interposed between the hammer and the frame resists substantial hammer movement until buckled or deflected by a surface on the trigger, which action occurs after sufficient compression of the hammer spring. After buckling, the resistance offered by the toggle spring device is reduced to such an extent that the compressed hammer spring drives the hammer to its fired position with sufficient energy to fire a cartridge. The hammer is returned to its normal position by the toggle spring device while the trigger is returned to its normal or released position by the hammer spring.

A revolver of the invention may also incorporate a cylinder which automatically indexes to the next cartridge position during trigger return. In an embodiment of the invention, rotation of the cylinder is urged by a torsion spring. A unique cylinder stop-locking recess arrangement allows the cylinder stop to clear the locking recess and permits cylinder rotation while being adapted to be received in the succeeding locking recess for terminating cylinder rotation at a discrete index position.

It will also be appreciated that the invention provides a useful method of operating a revolver with respect to hammer movement and cylinder rotation.

Accordingly, it is a primary object of the invention to provide a double action revolver without searing surfaces on the hammer and the trigger thereof.

Another object of the invention is to provide a method and apparatus for indexing a revolver cylinder.

A further object is to provide methods for operating the hammer and cylinder of a revolver.

These and other objects and advantages of the invention will become more readily apparent from the following detailed description, when taken in conjunction with the accompanying drawings, in which:

BRIEF DESCRIPTION OF THE DRAWINGS

FIG. 18 is a side elevational view of the upper frame member.

FIG. 19 is a bottom plan view of the upper frame member taken along the line 19—19 of FIG. 18.

FIGS. 20, 21 and 22 are respectively top plan, side elevational and rear elevational views of the cylinder stop, per se.

FIGS. 23 and 24 are respectively perspective and fragmentary rear elevational views of the trigger, per se.

FIGS. 25 and 26 are respectively side and front elevational views of the hammer, per se.

FIG. 27 is a view of the hammer return projection, taken along the line 27—27 of FIG. 25.

FIGS. 28 and 29 are side and plan views of the hammer spring, respectively.

FIGS. 30 and 31 are respective plan and side views of the toggle spring device.

FIG. 32 is a side view of the cylinder.

FIGS. 33 and 34 are respective sectional views of the cylinder, taken along the lines 33—33 and 34—34 of FIG. 32.

FIGS. 35 and 36 are respective side and rear views of the cylinder ratchet.

FIGS. 37 and 38 are respective side and front views of the cylinder guide.

FIG. 39 is a view of the cylinder guide, taken along the line 39—39 of FIG. 38.

FIG. 40 is a fragmentary perspective view of the cylinder guide.

FIGS. 41, 42, 43 and 44 are respectively side, top plan, rear end and front end views of the cylinder yoke in association with the cartridge retaining plate.

FIGS. 45 and 46 are rear and sectional views, respectively, of the cartridge retaining plate, per se.

FIG. 47 is a view of the cartridge plate biasing spring.

DETAILED DESCRIPTION OF PREFERRED EMBODIMENTS

Figure 1:
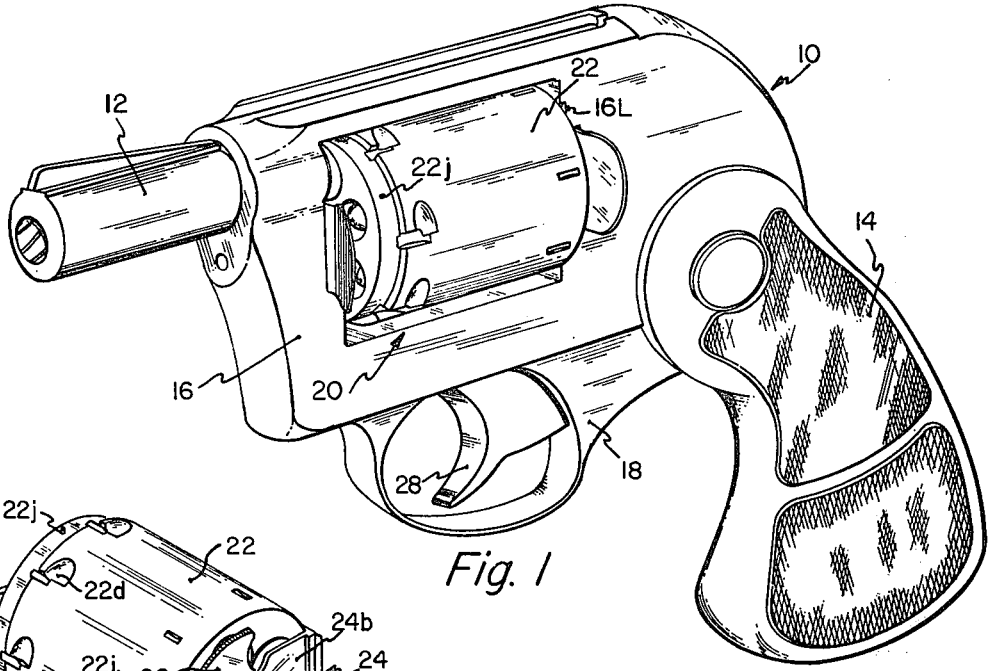
FIG. 1 is a perspective view of a revolver according to the invention.

Referring now to the drawings and more particularly to FIG. 1, there is shown a firearm according to the invention in the form of a revolver. The revolver comprises a frame, generally shown at 10, to which is secured a barrel 12 and a handgrip 14. The frame 10 is constituted by an upper frame member 16 and a lower frame member 18. Mounted in the upper frame member 16 is a cylinder assembly 20 adapted to be quickly removed from and inserted into the revolver.

Figure 2:
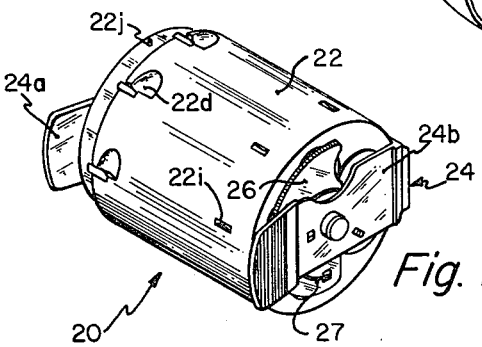
FIG. 2 is a perspective view of the cylinder assembly of the revolver of FIG. 1.
Figure 3:
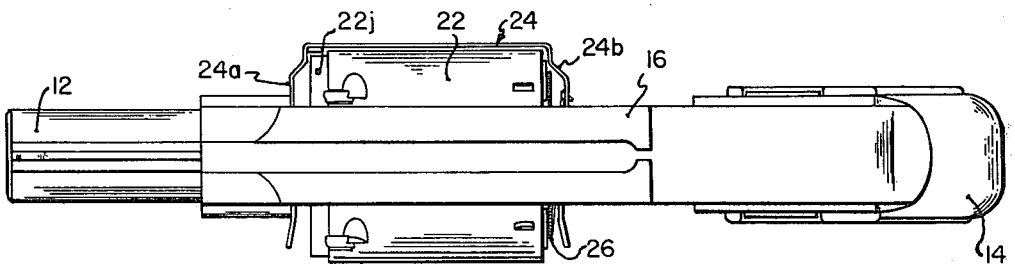
FIG. 3 is a top plan view of the revolver of FIG. 1.

The cylinder assembly 20, which is shown alone in perspective in FIG. 2 and from above in FIG. 3 when inserted in the revolver, comprises a cylinder 22, an embracing yoke 24, and a cartridge plate 26. The cylinder assembly 20, which permits automatic indexing of the cylinder 22 in its discrete firing positions, is shown and described in greater detail in the succeeding views and description.

Figure 4:
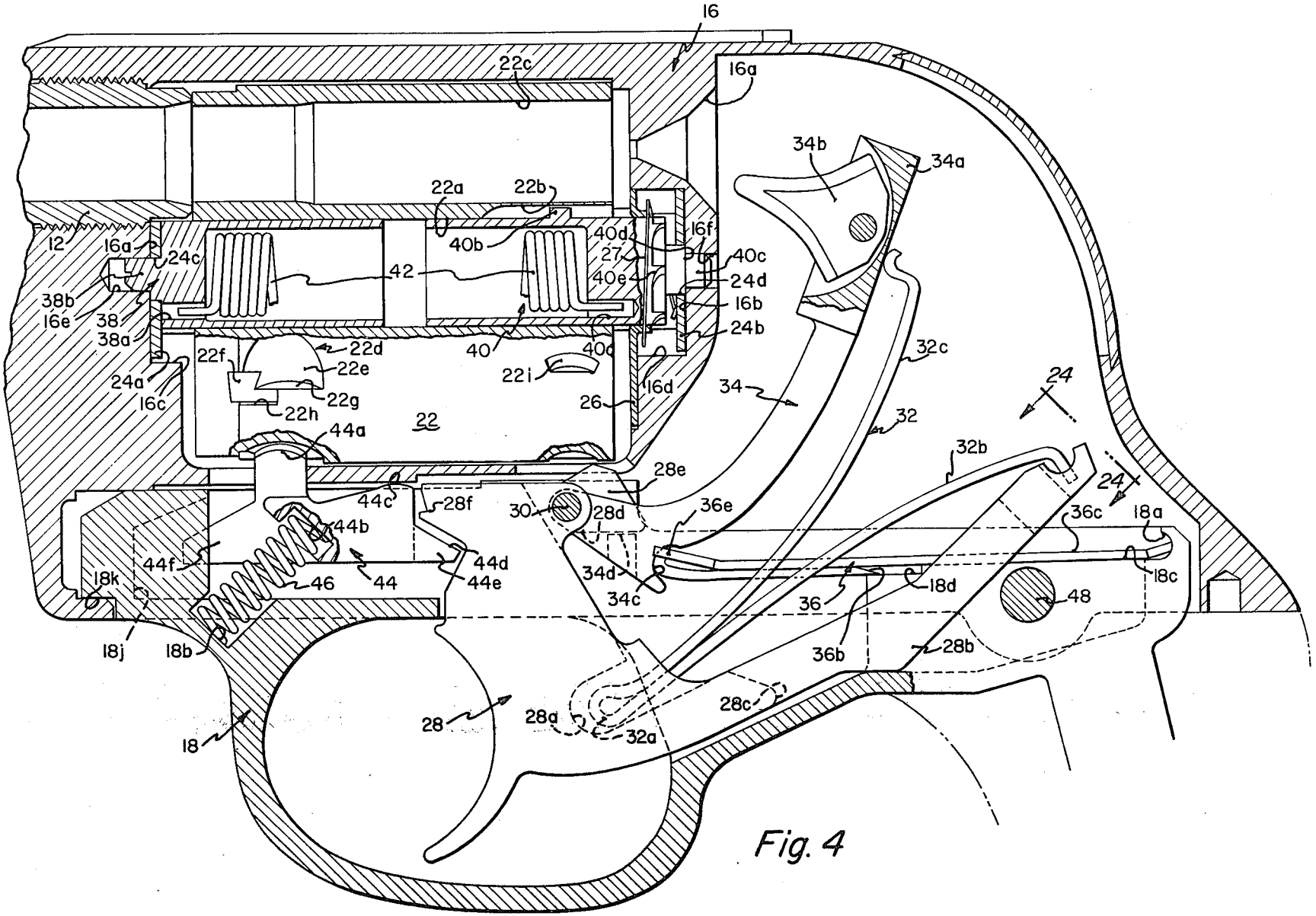
FIG. 4 is a sectional side elevational view of the revolver of FIG. 1 showing the components of the firing mechanism in their normal positions prior to trigger pull.

Turning now to FIG. 4, the components of the firing mechanism are shown in their respective normal positions prior to trigger pull. A trigger 28 is mounted for pivotal movement upon the lower frame member 18 by means of a pin 30. The rear portion of the trigger 28 is provided with a recess 28*a* in which the apex 32*a* of a somewhat V-shaped hammer spring 32 is positioned. The trigger 28 comprises a rearwardly extending arm 28*b*, the end of which receives the end of a leg 32*b* of the hammer spring 32. The other leg 32*c* has its end in sliding abutment with the head 34*a* of a hammer 34 which is mounted for pivotal movement upon the pin 30. On a pin in the head of the hammer 34 is mounted a pivoted striker 34*b*. The hammer spring 32 generally acts as a leaf spring.

A toggle spring device 36 has one end thereof seated in a recess 34*c* in the lower part of the hammer 34 and the other end thereof seated in a recess 18*a* in the lower frame member 18. The toggle spring device 36 resists substantial hammer movement while the trigger 28 is being initially pulled back from its normal or released position but permits hammer 34 to fall from the normal to the fired position when its resistance to such hammer movement is substantially reduced by buckling or deflection caused by contact with a surface 28*c* of the trigger 28. The buckled toggle spring device 36 urges the hammer 34 to return from the fired position thereof to the normal position thereof while the hammer spring 32 urges the trigger 28 to return from the pulled position to the normal position. In addition, hammer return is aided by the engagement between the returning trigger 28 and a projection 34*d* on the hammer 34. As shown in FIG. 4, the toggle spring device 36 comprises a portion of increased cross section caused by bending over a strip of the metal from which it is formed. The detailed construction and mounting of the illustrated toggle spring device 36 is discussed more fully hereinafter. For purposes of this part of the description, suffice it to say that the toggle spring device 36 is essentially a leaf spring which buckles in the manner of a column when a transverse force is applied thereto. When the hammer 34 moves into the fired position, the end of the striker 34*b*, which forms a part thereof, passes through a tapered opening 16*a* in the frame and contacts the primer of a cartridge in the cylinder 22.

Figure 5:
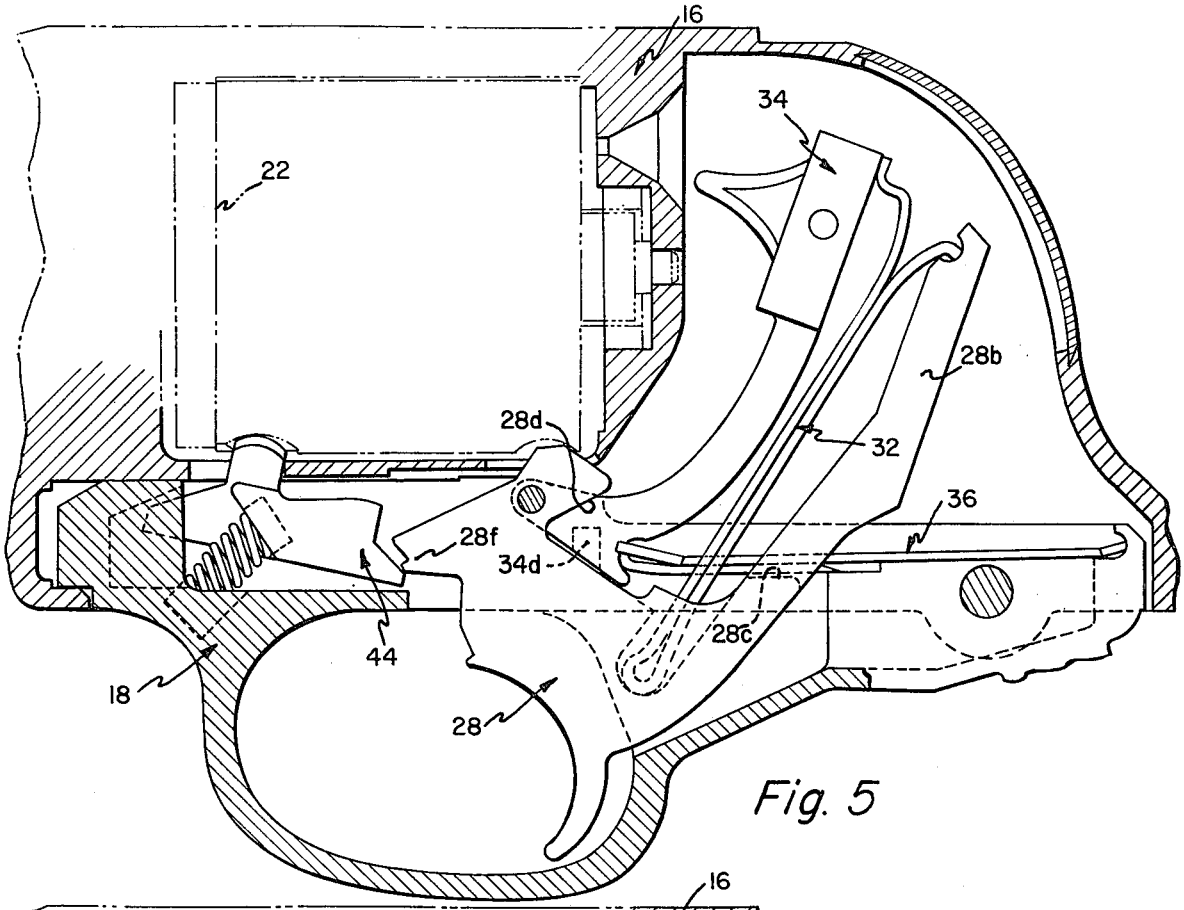
FIG. 5 is a view similar to that of FIG. 4 showing the positions of the components of the firing mechanism where the trigger is displaced to a position just prior to that which buckles the toggle spring device and releases the hammer for falling movement.
Figure 6:
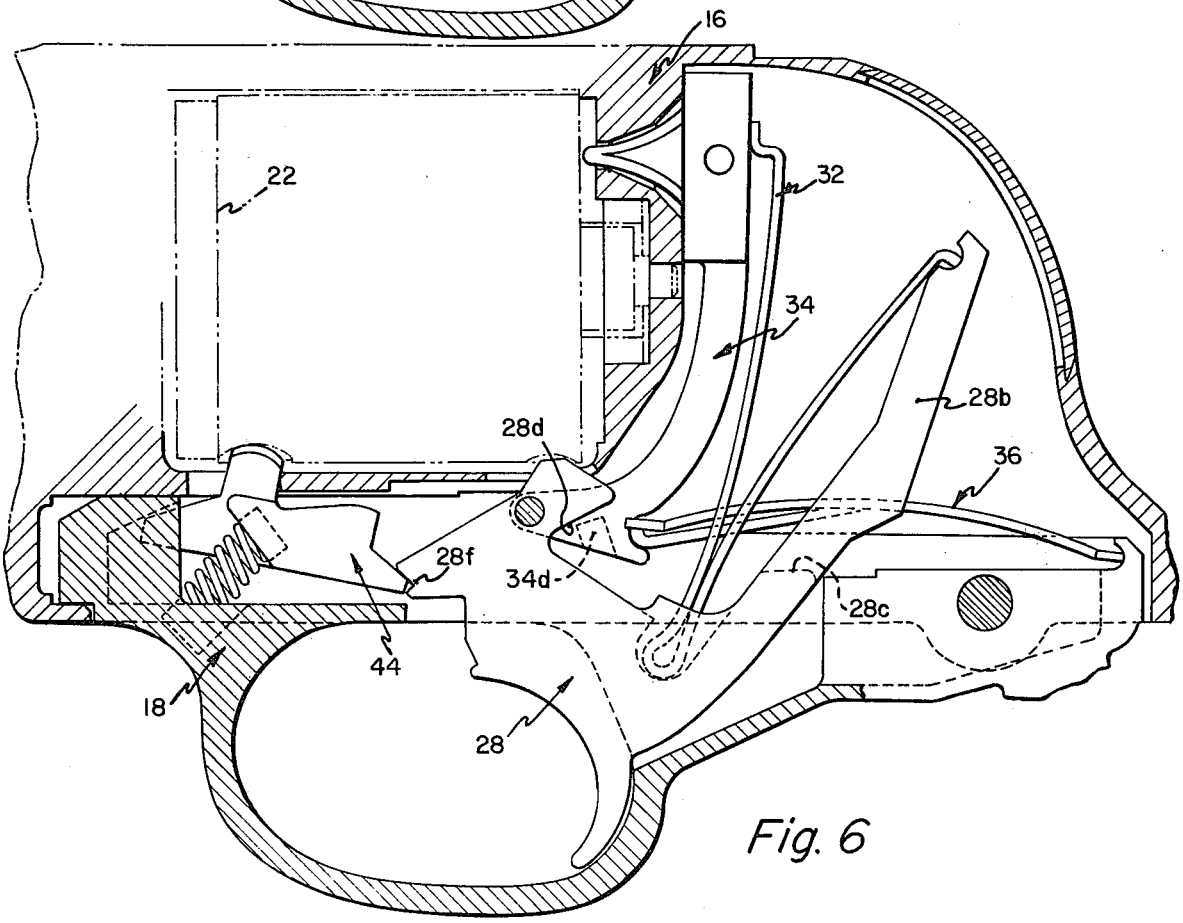
FIG. 6 is a view similar to those of FIGS. 4 and 5 showing the positions of the components of the firing mechanism where the trigger is in the pulled position and the hammer has fallen to the fired position.
Figure 7:
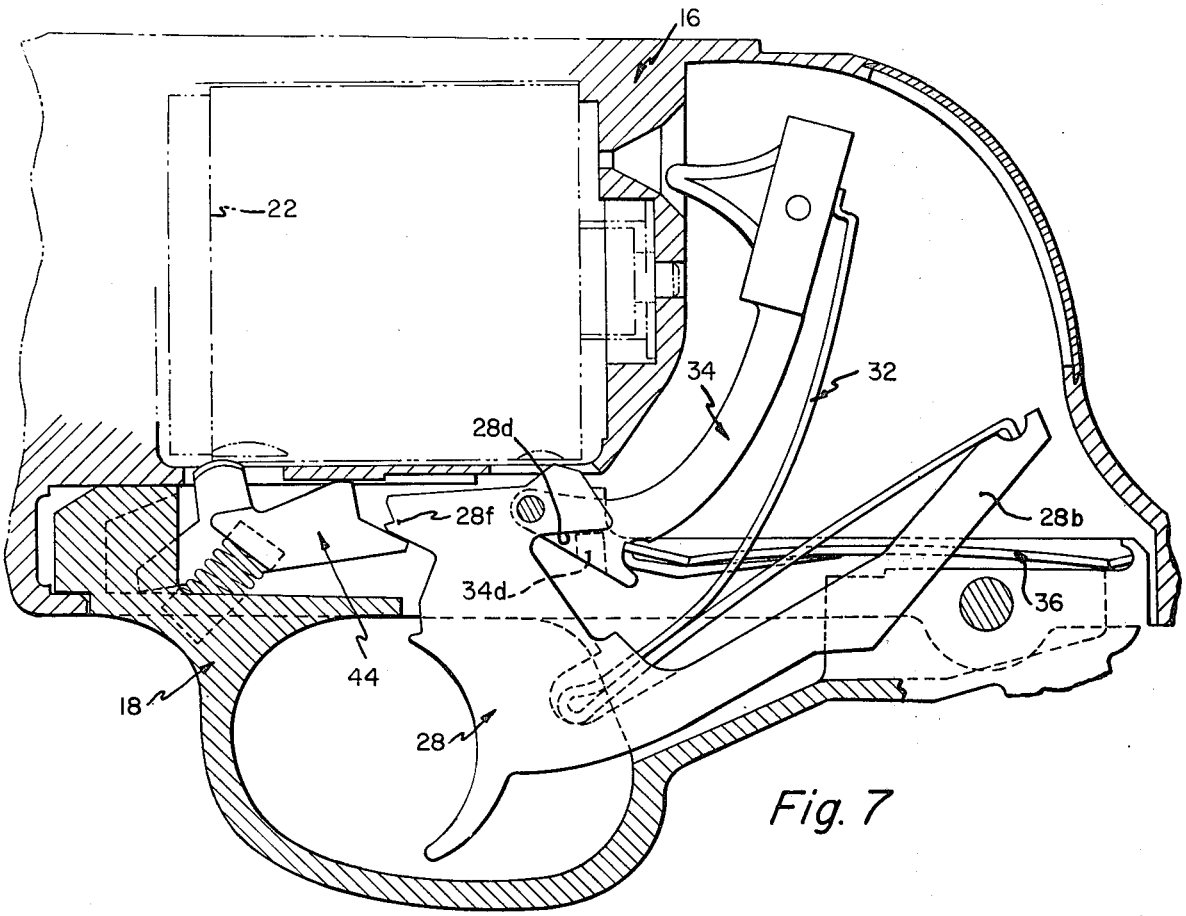
FIG. 7 is a view similar to those of FIG. 4, 5, and 6 showing the positions of the components of the firing mechanism where the trigger is positioned somewhere between its pulled and normal positions during return movement.

The manner of operation of the firing mechanism may be best appreciated by reference to FIGS. 5, 6, and 7. In FIG. 5, the trigger has been pulled to a position where the hammer spring 32 has been practically completely compressed and the surface 28*c* of the trigger 28 is just about to contact the toggle spring device 36. A further small increment of trigger rotation causes contact between the surface 28*c* and the lower side of the toggle spring device 36 whereupon still further slight trigger rotation causes the toggle spring device 36 to buckle. Such buckling permits the hammer spring 32 to then drive the hammer to its fired position, as is depicted in FIG. 6. It will be noted that the pulled (i.e., fully rearward) position of the trigger 28 is only slightly angularly displaced from its position in which the surface 28*c* initially contacts the toggle spring device 36. However, it will be seen that, in FIG. 6, the toggle spring device 36 has assumed a bowed configuration after deflection such that it is markedly spaced from the surface 28*c*.

When the hammer 34 is in the fired position and the trigger 28 is in the pulled or fully depressed position (as shown in FIG. 6), the hammer spring 32 is urging the trigger 28 to return to its normal position and is also urging the hammer 34 toward its fired position. Although, in this FIG. 6 configuration, the toggle spring device 36 is urging the hammer 34 to return from the fired position, such urging is at first insufficient to overcome the urging of the hammer spring and produce withdrawal of the striker 34*b* from engagement with the chambered spent cartridge. This is because the moment on the hammer 34 attributable to the hammer spring 34 is greater than the opposing moment on the hammer 34 generated by the toggle spring device 36. Since the cylinder 22 is indexed during trigger return, it is necessary in the illustrated embodiment to move the hammer 34 whereby it does not impede the travel of rotating cartridges. To this end, an abutment surface 28*d* is provided on an extension 28*e* of the trigger 28. The abutment surface 28*d* is adapted to engage the projection 34*d* on the hammer 34 during initial trigger return to withdraw the hammer 34 from the fired position and permit untrammeled rotation of the cylinder 22. This engagement is depicted in FIG. 7. As trigger return continues the moment exerted on the hammer 34 by the toggle spring device 36 increases while the moment exerted by the hammer spring 32 decreases. Eventually, during trigger return, the toggle spring device 36 snaps into its unbowed or normal configuration whereby the hammer 34 assumes its normal position. Trigger return then continues under the bias of the hammer spring 32 until the trigger leg 28*b* hits the frame, whereby the trigger assumes its normal position.

It will be understood that the firing mechanism of the invention need not be utilized only in conjunction with a cylinder that is automatically indexable but could be used with conventional cylinders which have ratchets driven by a trigger connected pawl. The firing mechanism may also find utility in firearms other than revolvers. In addition, the spring designs which are illustrated could be replaced by other spring designs. Moreover, a different spring arrangement may make it possible to dispense with the engagement between the trigger and hammer during trigger return. Furthermore, the hammer 34 could engage a conventional spring biased firing pin, if desired.

Returning now to FIG. 4, the cylinder assembly 20 will now be described in detail. The cylinder 22 has a central bore 22*a* passing therethrough and a keyway 22*b* communicating therewith. Partially contained within the central bore 22*a* at opposite ends thereof are a cylinder guide 38 which the cylinder 22 rotates over and a cylinder ratchet 40 which transmits torque thereto. The interiors of the guide 38 and ratchet 40 are hollowed to furnish a space for a torsion spring 42, which extends therebetween and has its ends respectively inserted in suitable sockets 38*a* and 40*a* in the guide 38 and the ratchet 40, respectively. The spring 42 also acts as a compression spring in that it biases the guide 38 and ratchet outwardly or away from the center of the cylinder and also urges relative rotation between the guide 38 and the cylinder 22 when wound. The torque transmitted by the spring 42 is applied to the cylinder 22 by means of a key 40*b* which is fashioned on the periphery of the ratchet 40 and received in the keyway 22*b*.

From FIGS. 1-4, it will be seen that the yoke 24 embraces the cylinder 22 and has two apertures 24*c* and 24*d* through which respective integral extensions 38*b* and 40*c* of the guide 38 and the ratchet 40 extend. The legs 24*a* and 24*b* of the yoke 24 extend through and rest against the respective vertical walls 16*a* and 16*b* of the cavities 16*c* and 16*d* which extend across the frame-barrel assembly in a transverse manner. The extensions 38*b* and 40*c* are, in turn, received within respective cavities 16*e* and 16*f* of the upper frame member 16. It will be seen that an intermediate annular surface 40*d* on the extension 40*c* is formed by an enlarged diameter segment of the extension. This annular surface 40*d* is urged by spring 42 against the upper frame member 16 and bears thereagainst during cylinder rotation.

The cylinder guide 38 bears against the yoke 24 and engages therewith (as explained hereinafter) such that relative rotation therebetween is prevented both when the cylinder assembly 20 is in the frame 10 and out of the frame 10. When the cylinder assembly 20 is inserted in the frame 10, as shown in FIG. 4, the cylinder is constantly being urged to rotate. However, when the cylinder assembly is taken out of the frame by squeezing the legs of the yoke 24, a plurality of teeth 40*e* move into contact with the inboard surface of leg 24*b* which has a protrusion (shown hereinafter) thereupon. The engagement between the protrusion of the yoke 24 and the teeth 40*e* prevents the ratchet 40, and, hence, cylinder 22, from being turned by the spring 42 relative to the yoke 24. It will be noted, however, that such engagement does not prevent relative rotation in the opposite direction, whereby energy can be stored in the spring 42 when the cylinder 22 is turned during loading. It will be understood, in this respect, that the contact between annulus 40*d* and the wall 16*b* precludes engagement between the teeth 40*e* and the inboard surface of leg 24*b* when the cylinder assembly is mounted in the frame.

In order to keep cartridges in the cylinder 22 from engaging the upper and lower walls of the cavity 16*d* and interfering with cylinder rotation and also for safety reasons, the plate 26 is mounted upon the ratchet 40. The plate 26 is biased (when the cylinder assembly 20 is out of the revolver) against a stop on the yoke 24 by means of a spring 27 attached to the stop on the yoke 24 and the plate 26. To load (when the cylinder assembly 20 is removed) a cartridge in the cylinder 22 of FIG. 2, the plate 26 is manually rotated about 45° counterclockwise from the position thereshown and a cartridge inserted in the exposed cylinder chamber. The cylinder is then incrementally turned against the bias of the spring 42 and the succeeding cylinder chambers are loaded. As the cylinder assembly 20 is being inserted in the revolver, a surface 16L (FIGS. 1 and 18) on the upper frame member 16 engages the plate 26 and causes about a 45° rotation, thereby to expose the primer of the upper cartridge.

The cylinder 22 is provided with a plurality of locking recesses 22*d* (best shown in FIGS. 1-4, 15, and 32-34) which are adapted to engage the locking projection 44*a* of a cylinder stop 44 for maintaining the cylinder 22 in a plurality of discrete index positions in which a chamber 22*c* thereof is aligned with the barrel 12. The locking recesses 22*d* are not of conventional geometry since they are each constituted by a primary notch 22*e* and a secondary notch 22*f*. The primary notch 22*e* is not conventional in shape as it only locks the cylinder against rotation in one direction. The recess 22*d* has a sloping entrance cut leading to an abutment wall 22*g* which is adapted to engage the projection 44*a* and terminate cylinder rotation in a discrete index position. The secondary notch 22*f* is shallower in depth than the primary notch 22*e* and begins just slightly forward the center line of the primary notch 22*e*. The secondary notch 22*f* extends to a circumferential station beyond that of the primary notch 22*d* such that its abutment wall 22*h* is circumferentially offset from the abutment wall 22*g* of the primary notch.

The reason for utilizing the illustrated locking recess design is to permit reciprocating (forward and rearward) movement of the cylinder stop 44 to index the cylinder 22 while the projection 44*a* always remains in contact with the surface thereof. Obviously, a cylinder stop which at some point in the trigger movement departed from the surface of the cylinder would be unsuitable as the cylinder would quickly rotate past the succeeding index positions under the bias of the spring 42.

In brief, what occurs is that during forward movement of the cylinder stop 44 the projection 44*a* clears the abutment wall 22*g* of the notch 22*e*, whereby the cylinder 22 rotates a few degrees until the projection 44*a* contacts the abutment wall 22*h* of the notch 22*f*. Then return or rearward movement of the cylinder stop 44 causes the projection 44*a* to slide out of the secondary notch 22*f* (and out of engagement with abutment wall 22*h*) to the outer periphery of the cylinder 22. The cylinder 22 now rotates until the projection 44*a* engages the abutment wall 22*g* of the succeeding locking recess 22*d*.

The cylinder stop 44 is biased upwardly and rearwardly by a compression spring 46 seated in respective cavities 44*b* and 18*b* in the cylinder stop 44 and lower frame member 18. In FIG. 4, the top of the projection 44*a* is being urged against the sloping entrance cut of the primary notch 22*e* and a shoulder 44*c* on the cylinder stop 44 bears against the upper frame member 16. The cylinder stop 44 also has a cam surface 44*d* fashioned upon a rear extension 44*e* thereof. During trigger pull (i.e., counterclockwise trigger movement) the nose 28*f* of the trigger 28 engages the cam surface 44*d* so as to cause the cylinder stop 44 to generally pivot about the end of the projection 44*a* while locking engagement is maintained; and during trigger return, the nose 28*f* of the trigger 28, which is contoured to engage the rear extension 44*e* of the cylinder stop 44, pushes the cylinder stop 44 forwardly until the nose 28*f* disengages from the end of the extension whereupon the cylinder stop 44 returns rearwardly with a snap action.

The cylinder 22 is also provided with a plurality of safety notches 22*i* which are adapted to partially receive the trigger extension 28*e* during trigger pull. The safety notches 22*i* are so positioned on the periphery of the cylinder 22 that the extension 28*e* can enter a notch only when a cylinder chamber is properly aligned with the barrel 12. If such alignment is not present, the trigger 28 cannot be pulled back far enough to produce hammer fall since the movement of the extension 28*e* will be impeded by the periphery of the cylinder 22.

The interaction between the trigger 28, the cylinder 22 and the cylinder stop 44 may best be understood by reference to FIGS. 8*a*–14*a*, and to FIGS. 8*b*–14*b*. The latter FIGS. (8*b*–14*b*) show the relationship of the projection 44*a* to the locking recess 22*d*. Also, each of the views of the former group of figures corresponds to a view in the latter group of figures which has the same numeral (e.g., the position of the projection in FIG. 12*a* is shown in FIG. 12*b*).

Figure 8A:
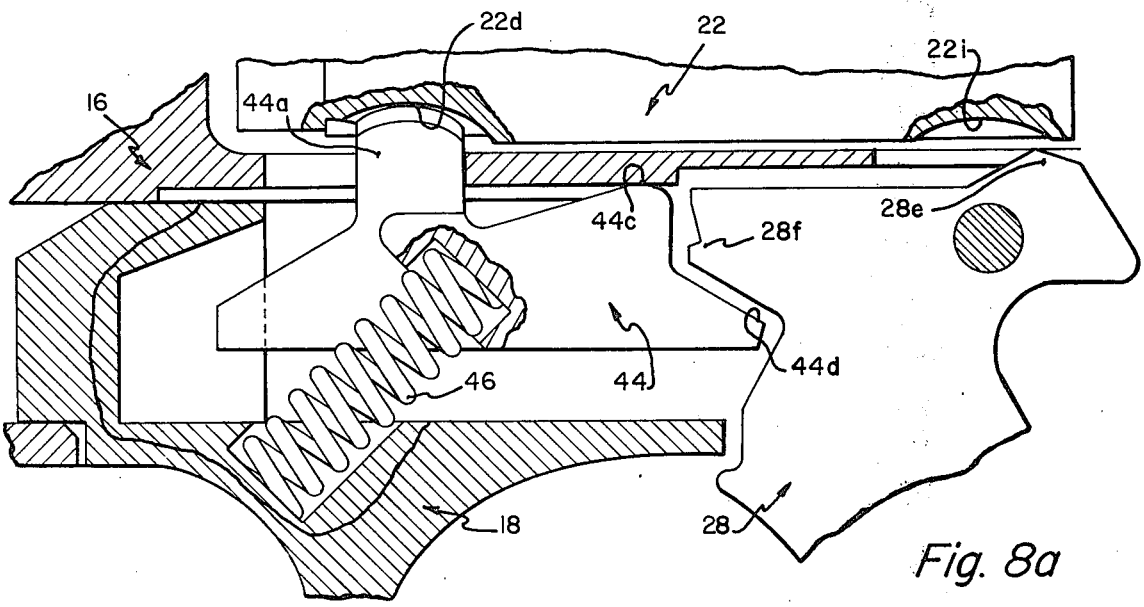
FIGS. 8*a*, 9*a*, 10*a*, 11*a*, 12*a*, 13*a*, and 14*a* are sequential views showing the interaction between the trigger, the cylinder stop and the cylinder during trigger pull and trigger return.
Figure 15:
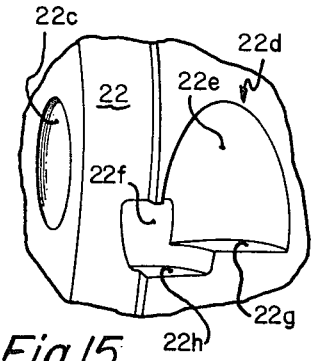
FIG. 15, is a perspective view of a locking recess on the cylinder.
Figure 8B:
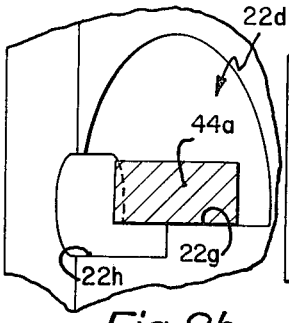
FIGS. 8*b*, 9*b*, 10*b*, 11*b*, 12*b*, 13*b*, and 14*b* are sequential views, which respectively correspond to the previously described views with similar numeral prefixes, showing the relationship between the locking projection of the cylinder stop and a locking recess on the cylinder.

In FIGS. 8*a* and 8*b*, the depicted elements are in their normal positions awaiting a pulling of the trigger 28. It will be noted that the projection 44*a* is received within the notch 22*e* in engagement with the abutment wall 22*g*, such engagement being urged by the spring 42.

Figure 9B:
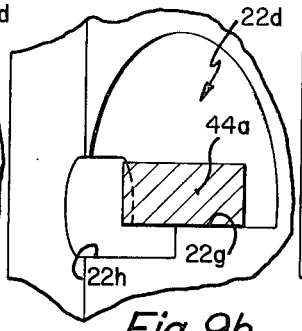
Figure 10B:
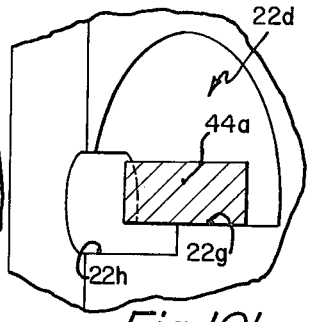
Figure 9A:
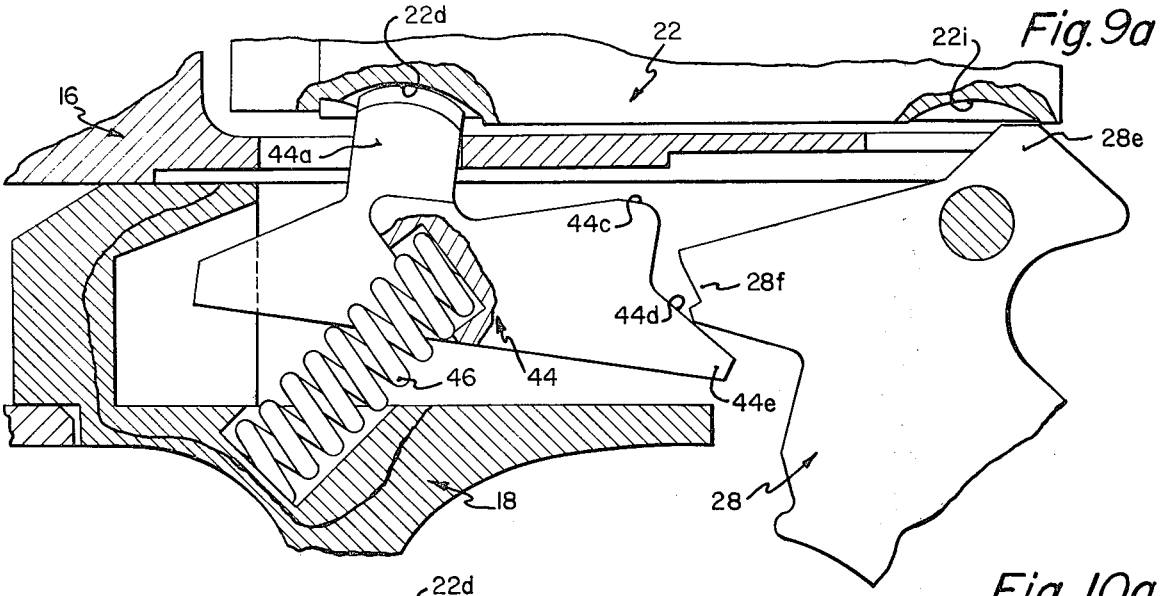

In FIGS. 9*a* and 9*b*, the trigger 28 is being pulled. The nose of 28*f* of the trigger 28 has engaged the cam surface 44*d* and produced a pivoting of the cylinder stop 44 about the end of its projection 44*a*. As shown in FIG. 9*b*, the relative positions of the projection 44*a* and the locking notch 22*e* remain substantially unchanged.

Figure 10A:
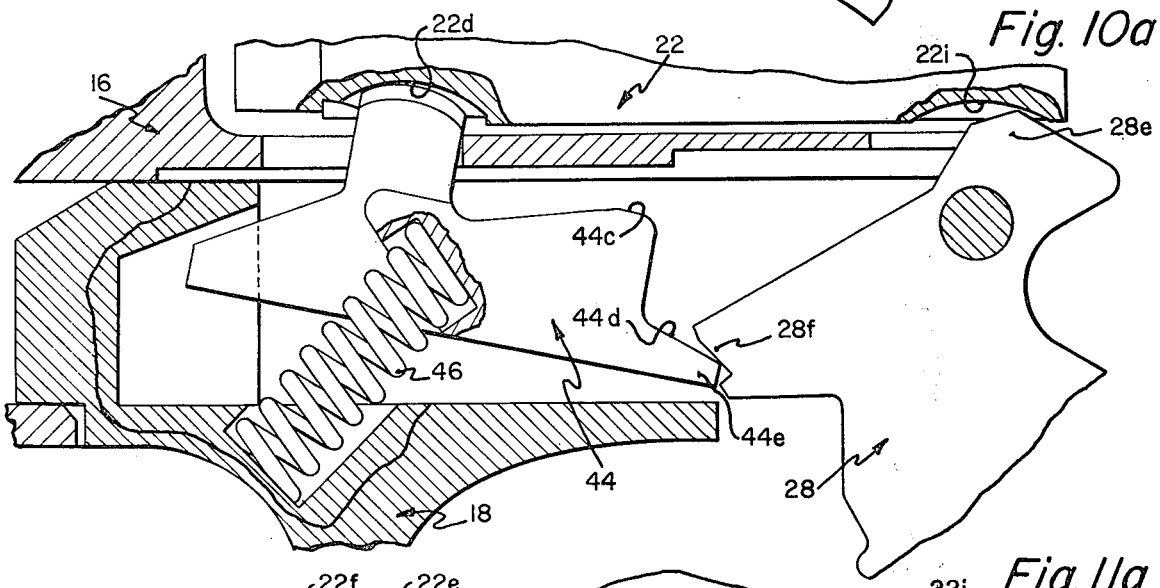

FIG. 10*a* shows the trigger 28 in the pulled position after the revolver has been fired and a V-shaped cut on the nose 28*f* of the trigger 28 engages the rear end of the rear extension 44*e* of the cylinder stop 44. The end of the rear extension 44*e* snaps into the V-shaped cut after the base of the nose 28*f* has cleared the cam surface 44*d*. Again with reference to FIG. 10*b*, the relationship between the projection 44*a* and the notch 22*e* has not been substantially changed, although the cylinder stop has pivoted further about the end of its projection 44*a*.

Figure 11B:
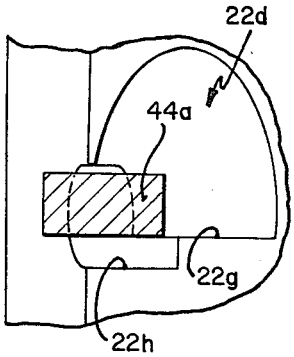
Figure 11A:
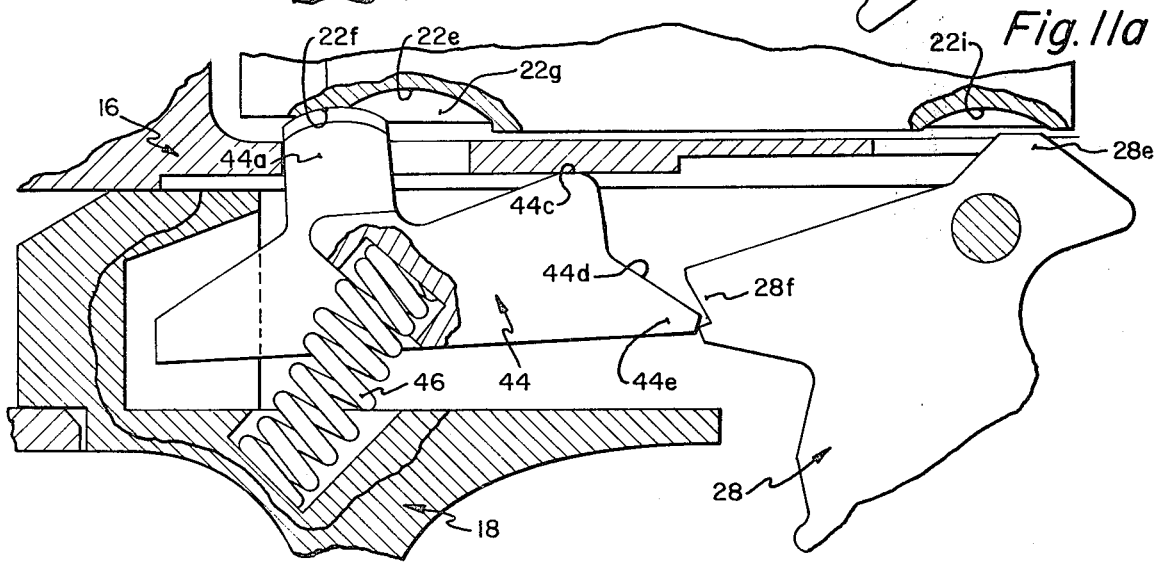

FIGS. 11*a* and 11*b* show the cylinder stop 44 being pushed forward by the trigger 28 during trigger return. It will be seen that the V-shaped cut in the nose 28*f* of the trigger is still in engagement with the end of extension 44*e*. FIG. 11*b* illustrates the position of projection 44*a* relative to the locking recess 22*d* just before it disengages from the abutment wall 22*g* and enters the secondary notch 22*f*.

Figure 12B:
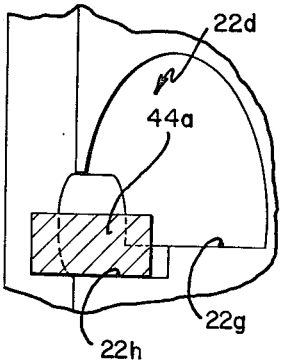
Figure 12A:
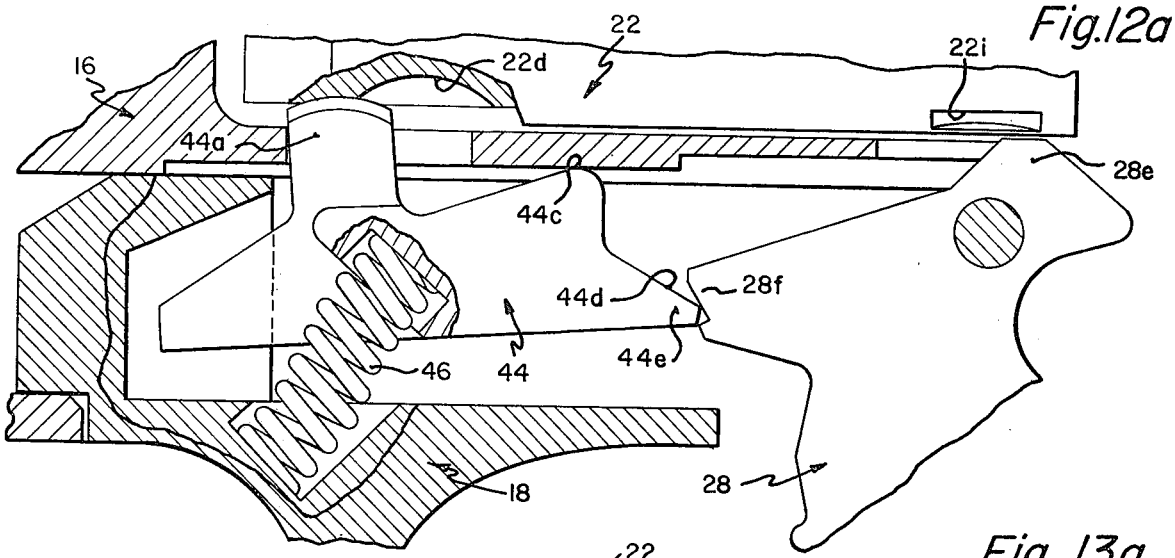

In FIGS. 12*a* and 12*b*, with trigger return continuing, the projection 44*a* has cleared the abutment wall 22*g* and the cylinder 22 has been rotated under the bias of spring 42 an amount sufficient to beget engagement between the projection 44*a* and abutment wall 22*h*. It should be mentioned at this point that an indexing rotation of the cylinder 22 cannot take place until the projection 44*a* clears the abutment wall 22*h* which is now being urged by spring 42 into contact therewith.

Figure 13B:
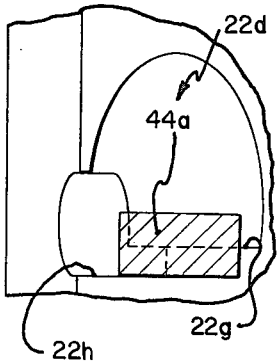
Figure 13A:
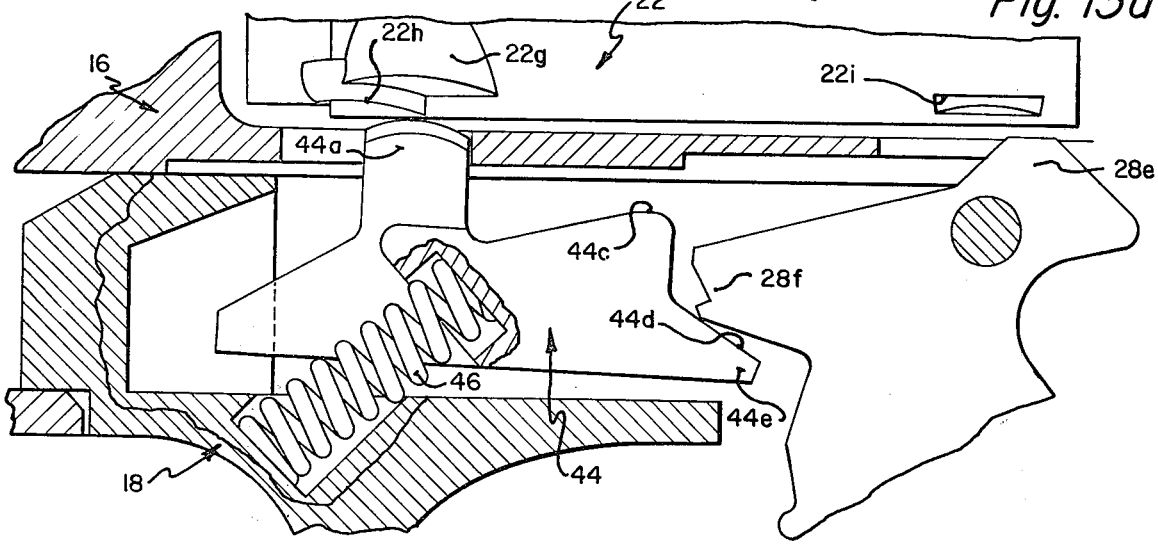

With reference now to FIGS. 13*a* and 13*b*, the rear extension 44*e* of the cylinder stop 44 has snaped rearwardly under the urging of the spring 46 and the cam surface 44*d* now bears against the underside of the nose 28*f* of the trigger 28. As soon as the nose 28*f* has cleared the end of the extension 44*e*, the above described rearward motion is occasioned. This rearward movement has caused the projection 44*a* to slide out of the secondary notch 22*f*, out of engagement with the abutment wall 22*h* and onto the periphery of the cylinder 22.

Figure 14B:
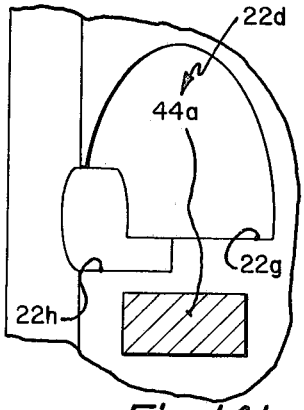
Figure 14A:
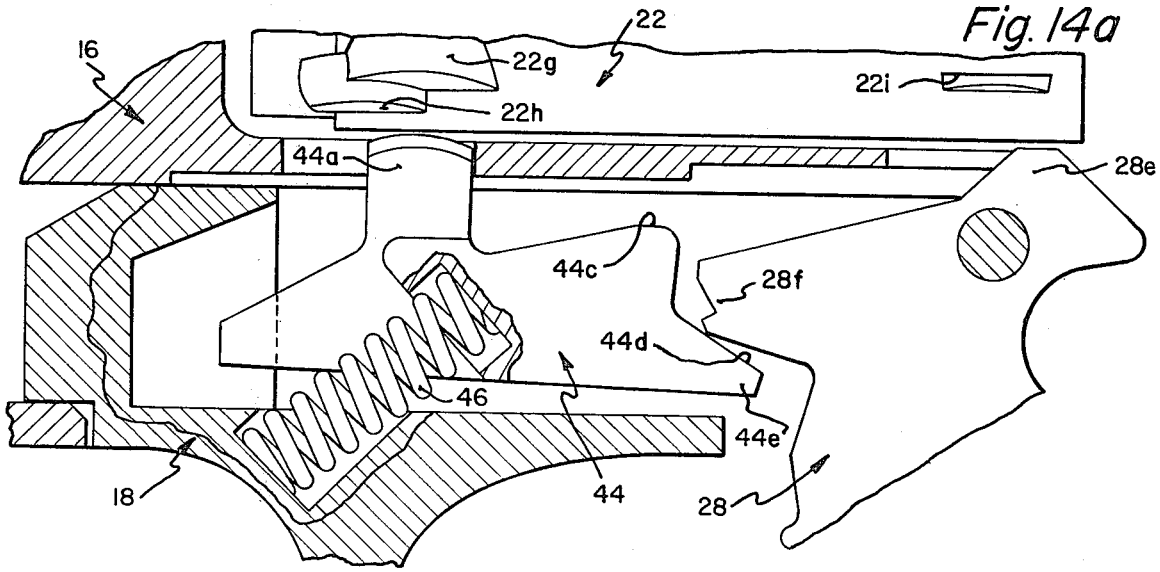

When the projection clears the abutment wall 22*h*, the cylinder 22 begins to rotate as shown in FIGS. 14*a* and 14*b*. The projection is now in position to enter the next sloping entrance cut of the succeeding primary locking notch 22*e* and be contacted by the abutment wall 22*g* thereof. Further trigger return merely causes a slight pivoting of the cylinder stop 44 until the shoulder 44*c* engages the upper frame member 16.

FIGS. 16–47 are detailed views of certain parts of the illustrated revolver which should be referred to in conjunction with the other figures.

Figure 16:
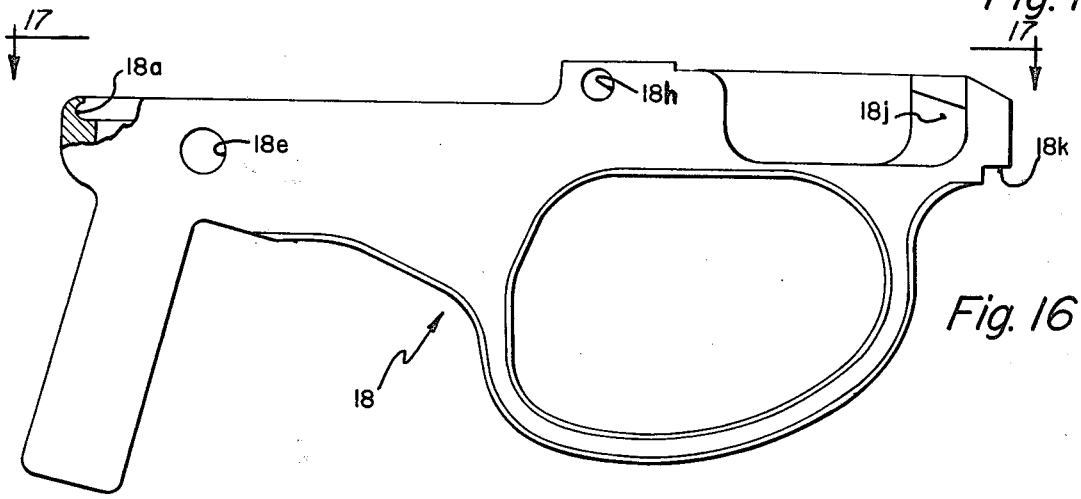
FIG. 16 is a side elevational view of the lower frame member.
Figure 17:
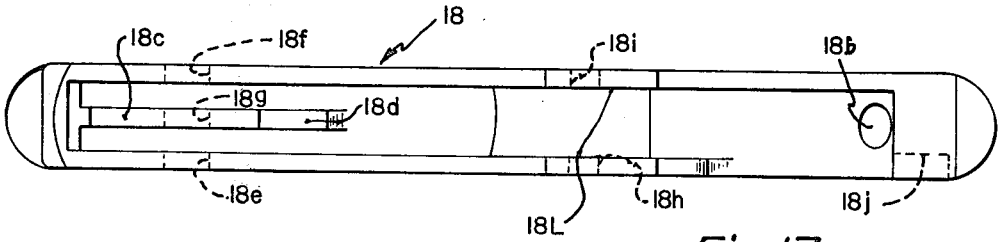
FIG. 17 is a top plan view of the lower frame member, taken along the line 17—17 of FIG. 16.

With reference to FIGS. 16 and 17, the lower frame member 18 is shown as having aligned bores 18*e*, 18*f*, and 18*g* extending laterally therethrough which receive a pin 48. The pin 48 is adapted to secure the frame members 16 and 18 together. Yet another set of aligned bores 18*h* and 18*i* in the sides of the frame member 18 are adapted to mount the trigger pin 30 about which the trigger 28 and hammer 34 pivot. The front portion of the lower frame member 18 is also recessed at 18*j* such that, together with the side of the upper frame member 16, a channel is defined for partially receiving the front extension 44*f* of the cylinder stop 44 for ease of assembly. The front end of the lower frame member 18 is also stepped at 18*k* to mate with a surface on the upper frame member 16 such that a relatively flush contour is provided therebetween. From FIG. 17, it will also be observed that the surfaces 18*c* and 18*d*, upon which the toggle spring device 36 is supported, are relatively narrow in width and are formed by a raised portion of the lower frame member 18. This support is essential to restrict downward deflection of the toggle spring device 36 during trigger pull.

FIGS. 18 and 19 show the upper frame member 16. It can be seen therefrom that the upper frame member 16 also has a set of aligned bores 16*g* and 16*h* which receive the pin 48. The upper frame member 16 also has windows 16*i* and 16*j* formed therein through which the trigger extension 28*e* and the cylinder stop projection 44*a* may respectively extend. As is apparent from FIG. 4, the lower frame member 18 is received within the upper frame member 16 in the lower part of the cavity therein. Such an arrangement contributes to rapid assembly and disassembly of the revolver and facilitates assembly and inspection of the working mechanism which is contained in its entirety in the lower frame member 18.

The cylinder stop 44, shown in FIGS. 20, 21, and 22, is relieved adjacent the cam surface 44*d* thereof whereby a side 44*g* thereof is in sliding contact with the right interior inboard side 16*k* of the upper frame member 16. The other side 44*h* of the cylinder stop 44 is in sliding contact with the interior inboard side 18L of the lower frame member 18. In addition, from FIGS. 21 and 22, it will be appreciated that the upper end of the projection is suitably contoured both in lateral slope and curvature to be properly accepted in a locking recess on the cylinder at one of the discrete index positions. The cylinder stop 44 is also provided with lightening recess 44*i* to reduce the inertia thereof.

From FIGS. 23 and 24, the construction of the illustrated trigger 28 is made more apparent. The bifurcated nature of the arm 28b permits the toggle spring device to extend therethrough. Also, the rear end of the arm 28b is furnished with two aligned semicircular recesses 28g and 28h for seating of the hammer spring 32.

In FIGS. 25, 26, and 27, the projection 34d of the hammer is shown as presenting a flat surface 34e for engagement by the trigger extension 28e. Also, it will be noted that the projection has a shape which is compatible with investment casting metal flow.

The hammer spring 32 of FIGS. 28 and 29 is made of spring steel and may be easily formed by standard stamping methods. The hammer spring 32 has a bend in the leg 32b which terminates in a protrusion 32d straddled by surfaces 32e and 32f (FIG. 24). It is these surfaces which are seated within the recesses 28g and 28h, the protrusion preventing lateral movement of the leg 32b. The end of the leg 32c is contoured as shown to provide a surface 32L which urges the hammer toward the fired position and which is adapted to slide over the head 34a thereof. The reason for providing elongated cutaway portions 32g and 32h is to allow for passage of the toggle spring device 36 therethrough. Also, it will be noted that reduced width of apex 32a allows entry thereof into cavity 28a of the trigger 28.

With reference to FIGS. 30 and 31, the structure of the toggle spring device 36 may be more fully appreciated. The toggle spring device 36 is essentially a leaf spring which restricts hammer movement until buckled or deflected by the surface 28c on the trigger 28. A portion of the toggle spring device 36 is double the thickness of the other portion to prevent downward buckling as the trigger 28 is being pulled. This is achieved by the bending back of segment 36a. It will be noted that a sloping surface 36b is fashioned on the end of the lower segment 36a. The function of this surface is to prevent failure of the toggle spring device caused by repeated flexing. What this sloping surface does is to reduce flexing of the sharp bend between segments 36a and 36c, the shorter segment 36a tending to remain straight when the toggle spring device is buckled.

The upper segment 36c of the toggle spring device 36 has a flange 36d at one end adapted to fit in recess 18a of the lower frame member 18 and a pair of prongs 36e and 36f at the other end adapted to straddle the lateral sides of the hammer 34. By virtue of such mounting, the toggle spring device is constrained against any twisting. Returning now to FIG. 4, it will be seen that the rear portion of the upper segment 36c rests upon surface 18c and the end of lower segment 36a rests upon surface 18d. This support is necessary to minimize downward buckling during trigger pull. The front portion of the toggle spring device 36, being of a greater thickness, also resists any significant downward buckling during trigger pull, although there will be a slight downward deflection. The toggle spring device 36 is necessarily made of spring steel.

The shape of the locking recesses 22d and the safety notches 22i while viewing the longitudinal direction may best be appreciated by reference to FIGS. 32, 33, and 34. From FIG. 33, it will be noted that the primary notches 22e are twice the radial depth of the secondary notches 22f. This is because a larger abutment surface is needed to absorb the impact force of the rotating cylinder on the projection 44a without surface deterioration.

As FIGS. 35 and 36 reveal, the ratchet 40 is a cylindrical structure with six circumferentially spaced ratchet teeth 40e. The reason for having only six teeth is to insure that a cartridge primer will not be exposed when the cylinder assembly is out of the revolver, irrespective of cylinder position. As previously noted, the teeth 40e are adapted to permit rotation relative to the yoke 24 in only one direction when the cylinder assembly 20 is removed from the revolver.

Turning now to FIGS. 37–39, the extension 38b of the cylinder guide 38 has a contour, the projected area of which is slightly smaller than that of the aperture 24c (FIG. 43) in leg 24a of the yoke 24. The projected area, which is that of a circle with a missing circular segment, is defined by the cylindrical surface 38c and flat surface 38d. The extension 38b also comprises a reduced diameter portion 38e, having a slot 38f for receipt of a screwdriver head, which is received in cavity 16e in the frame 16. Obviously, with this geometry, the extension 38b can be inserted through the aperture 24c. Extension 38b also comprises a sloping flat surface 38g which intersects and forms an angle with the surface 38d, thereby defining a flange 38h. The flange 38h is adapted to overlie the outboard surface of leg 24a after a preload has been imparted to the cylinder spring 42 for preventing inadvertent passage of the extension back through the aperture 24c. This could occur if inward pressure were applied to extension 38b.

After assembly of the cylinder assemly 20, a preload is placed upon the spring 42 by pushing in the guide relative to the yoke 24 and turning the guide 38 with a screwdriver a few turns (e.g., 3 turns) in the counterclockwise direction of FIG. 38. The guide 38 is thereafter aligned with the aperture 24c and the inward pressure on the guide 38 released, whereby the extension 38b travels outwardly through the aperture 24c until the surface 38i of the guide 38 contacts the inboard surface of the leg 24a of the yoke 24. The screwdriver head is then removed from the slot 38f, whereupon the guide 38 rotates about 30° in a clockwise direction until surface 38g establishes engagement with the horizontal boundary 24e of the aperture 24c. An operator of the revolver need never by concerned with the above-described procedure as it is only performed once during manufacture.

The construction of the yoke 24 and its relationship to the cartridge retaining plate 26 is best shown in FIGS. 41–44. The plate 26 per se is depicted in FIGS. 45–46. The legs 24a and 24b of the yoke 24 are serrated at their ends to facilitate the forefinger and thumb of a user grasping and squeezing the legs in an inboard direction so that the cylinder assembly 20 may be inserted in or removed from the upper frame member 16 of the revolver. The legs 24a and 24b also comprise shoulders 24f and 24g which, when the cylinder assembly is only partially inserted in the frame, will engage the walls 16a and 16b when pressure on the legs is released to maintain the legs in a sufficiently inwardly deflected position whereby the ratchet teeth 40e will engage a protrusion 24h fashioned on the inboard surface of leg 24b and thereby not permit the cylinder 22 to unwind even though the extensions 40c and 38b of the ratchet and guide have their ends in contact with the respective vertical walls 16b and 16a. Because of these shoulders 24f and 24g, the cylinder assembly 20 may be slided in without a user maintaining squeezing pressure until the extensions snap into their respective cavities.

It will also be noted that the center section 24i of the yoke 24 is furnished with a bent portion 24j which is adapted to contact a stop abutment 22j on the front of the cylinder 22 to prevent the cylinder 22 from being wound-up beyond a one-turn rotation or unwound more than a turn; if the latter were possible, the preset spring preload could inadvertently be removed. As the cylinder assembly 20 snaps into place, the cylinder 22 will then only rotate to a position in which the cylinder stop 44 engages the abutment wall 22*g* of the primary locking notch 22*e* of the adjacent locking recess.

The cartridge plate 26 has an opening 26*a* which receives the ratchet 40 upon which it is mounted. The spring 27, which is shown in FIG. 47, is attached to protrusions 26*b* and 24*k* formed on the plate 26 and the yoke 24, respectively. The spring 27 urges twisting of the plate in the clockwise direction into contact with the inclined surface 16*L* of the upper frame member 16 when viewed from the rear of the revolver. When the cylinder assembly 20 is removed from the frame 10, the spring 27 urges rotation of the plate 26 such that another protrusion 26*c* on the plate 26 comes into contact with the protrusion 24*k*, whereby further rotation is prevented. The plate is also urged toward the primer end of the cartridges chambered in the cylinder by the spring 27. When outside the frame 10, the plate 26 covers the primers which are not covered by the yoke to forestall any contact therewith which could be caused by, for example, dropping the cylinder assembly. The cartridge plate 26 is an important part of the cylinder assembly 20 because it insures free cylinder rotation and enhances the safety of the assembly outside of the revolver. Without the cartridge plate, firing the revolver in elevated positions could cause the cartridges to slide rearwardly out of their chambers 22*c* into recess 16*d* and thereby impede the rotation of the cylinder 22.

Obviously, many modifications and variations are possible in light of the above teachings without departing from the scope or spirit of the invention as defined in the appended claims.

We claim:

1. In a firearm of the type having: a frame; a hammer mounted on the frame for movement between normal and fired positions; a trigger mounted on the frame for movement between normal and pulled positions; and a main spring interposed between the hammer and the trigger for driving the hammer to the fired position, the main spring being adapted to be compressed by moving the trigger from the normal position thereof toward the pulled position thereof without substantial hammer movement from the normal position thereof, the improvement comprising:

a toggle spring device interposed between the hammer and the frame for resisting substantial hammer movement from the normal position thereof while the main spring is being compressed and for urging return movement of the hammer from the fired position thereof to the normal position thereof; and means responsive to movement of the trigger for contacting and buckling the toggle spring device to change the resistance thereof such that the compressed main spring may drive the hammer to the fired position thereof.

2. The improvement of claim 1, further comprising:

the hammer and the trigger being mounted on the frame for pivoting movement about a common axis.

3. The improvement of claim 1, wherein the main spring comprises:

a V-shaped leaf spring having an apex and two legs, the apex of the main spring being positioned in the trigger.

4. The improvement of claim 3, wherein the end of one of the legs of the main spring is mounted on the trigger and the other of the legs has its end in sliding engagement with the hammer.

5. The improvement of claim 1, wherein the toggle spring device comprises:

a leaf spring having a portion of its length thicker than the remaining portion; and wherein the frame comprises:

surface means to prevent deflection in a first direction of the toggle spring device during the trigger pull, the resistance of the toggle spring device being reduced by buckling in a second direction opposite to the first direction.

6. The improvement of claim 5, wherein the trigger movement responsive means comprises:

a surface on the trigger.

7. The improvement of claim 1, further comprising:

means to withdraw the hammer from the fired position during return movement of the trigger from the pulled position to the normal position.

8. In a revolver of the type having: a frame; a cylinder mounted in the frame for rotation between discrete index positions, the cylinder having a plurality of locking recesses on the periphery thereof; a cylinder spring operatively connected to the cylinder for producing rotation thereof; a trigger mounted in the frame for movement between normal and pulled positions; a cylinder stop having a projection thereupon mounted in the frame forwardly of the trigger such that the projection is adapted to be received within a locking recess; and a cylinder stop spring mounted in the frame and connected to the cylinder stop for urging the projection against the cylinder and for urging the cylinder stop rearwardly toward the trigger; the improvement comprising:

each of the locking recesses being constituted by a primary locking notch with an abutment wall and a secondary locking notch with an abutment wall circumferentially and axially spaced forwardly from the abutment wall of the primary locking notch; and a surface on the trigger adapted to engage the cylinder stop during trigger return and push the cylinder stop forwardly such that the projection leaves the primary locking notch and enters the secondary locking notch and adapted to disengage from the cylinder stop during further trigger return such that the cylinder stop may move rearwardly under the impetus of its spring urging out of the secondary locking notch and onto the periphery of the cylinder, whereby the cylinder can rotate to the succeeding index position.

9. The improvement of claim 8, further comprising:

a plurality of safety notches on the periphery of the cylinder; and an extension on the trigger adapted to enter a safety notch during movement of the trigger from the normal position thereof to the pulled position thereof when the cylinder is in an index position, the extension contacting the periphery of the cylinder during trigger movement to the pulled position thereof when the cylinder is not at an index position to prevent further trigger movement and possible firing of the revolver.

10. In a cylinder assembly of the type adapted to be placed within a frame of a revolver and of the type having a cylinder with a plurality of cartridge chambers and a central bore extending therethrough, the improvement comprising:

a cylindrical cylinder guide positioned in one end of the bore, the guide having an extension thereupon for receipt in cavities in the frame;

a cylindrical ratchet, having a plurality of teeth, positioned in the other end in driving connection with the cylinder;

a spring mounted in the central bore in engagement with the guide and ratchet, the spring being adapted to urge the guide and ratchet away from the cylinder and to urge rotation of the cylinder;

a yoke for mounting in the frame having two legs with respective apertures therein, the extensions of the guide and ratchet being respectively received in the apertures such that the guide is prevented from rotating in its aperture and the ratchet is free to rotate in its aperture; and means on the yoke to engage the teeth when the assembly is out of the frame to prevent rotation of the cylinder relative to the yoke under the impetus of the spring while permitting rotation of the cylinder relative to the yoke to store energy in the spring.

11. The improvement, as defined in claim 10, further comprising:

a cartridge plate mounted for limited rotation on the ratchet for preventing rearward movement of cartridges in the chambers and covering exposed primers thereof.

12. In a revolver of the type having: a frame; a trigger mounted on the frame for movement between normal and pulled positions; a cylinder, having a plurality of locking recesses for indexing, mounted in the frame for rotation between discrete index positions during trigger return from the pulled position to the normal position, the improvement comprising:

a plurality of safety notches on the periphery of the cylinder; and an extension upon the trigger adapted to enter one of the safety notches during movement of the trigger from the normal position thereof to the pulled position thereof when the cylinder is in an index position and adapted to contact the periphery of the cylinder during trigger movement to the pulled position thereof when the cylinder is not at an index position to prevent further trigger movement and possible firing of the revolver.

13. In a method for rotating a cylinder between index positions in a revolver of the type which includes the steps of: urging rotation of the cylinder with a spring; maintaining contact with a first abutment wall on the cylinder to prevent the cylinder from rotating from an index position; and terminating contact with the first abutment wall to permit the cylinder to rotate, the improvement comprising:

establishing contact with a second abutment wall on the cylinder after the cylinder has rotated through an angular increment smaller than that between adjacent index positions to stop cylinder rotation at a location between index positions;

terminating contact with the second abutment wall to permit the cylinder to rotate; and establishing contact with a third abutment wall to stop cylinder rotation at another index position.

14. The improvement, as defined in claim 13, wherein the terminating of contact with the first abutment wall comprises:

moving a cylinder stop from a first axial station on the cylinder to a second axial station on the cylinder; and wherein the terminating of contact with the second abutment wall comprises:

moving the cylinder stop from the second axial station to the first axial station.

15. In a method of operating a firearm of the type which includes the steps of: compressing a main spring against a striking device to bias the device toward a cartridge while substantially maintaining the position of the striking device relative to the cartridge; and releasing the striking device after the main spring has been compressed to allow the main spring to drive the striking device toward the cartridge, the improvement comprising:

buckling a toggle spring device connected to the striking device to effect the releasing of the striking device, the toggle spring device serving to maintain the position of the striking device before the buckling thereof and to bias the striking device away from the cartridge after the buckling thereof.

16. The improvement, as defined in claim 15, wherein the firearm has a trigger mounted thereupon connected to the mainspring and wherein the compressing comprises pulling the trigger; and wherein the buckling comprises:

bringing the trigger and toggle spring device into engagement.

* * * * *